US010612260B2

(12) United States Patent
Cheng et al.

(10) Patent No.: US 10,612,260 B2
(45) Date of Patent: Apr. 7, 2020

(54) INTELLIGENT CAR GARAGE-MOVING DEVICE BASED ON SINGLE-CHIP MICROCOMPUTER CONTROL

(71) Applicant: Jiangnan University, Wuxi (CN)

(72) Inventors: Feng Cheng, Wuxi (CN); Weixi Ji, Xuxi (CN); Kaiwen Zhou, Wuxi (CN)

(73) Assignee: JIANGNAN UNIVERSITY, Wuxi (CN)

( * ) Notice: Subject to any disclaimer, the term of this patent is extended or adjusted under 35 U.S.C. 154(b) by 136 days.

(21) Appl. No.: 15/747,152

(22) PCT Filed: Dec. 28, 2016

(86) PCT No.: PCT/CN2016/112617
§ 371 (c)(1),
(2) Date: Jan. 24, 2018

(87) PCT Pub. No.: WO2018/076527
PCT Pub. Date: May 3, 2018

(65) Prior Publication Data

US 2019/0277049 A1 Sep. 12, 2019

(30) Foreign Application Priority Data

Oct. 26, 2016 (CN) ..... 2016 1 09434325

(51) Int. Cl.
*E04H 6/22* (2006.01)
*E04H 6/18* (2006.01)

(52) U.S. Cl.
CPC ..... *E04H 6/185* (2013.01); *E04H 6/22* (2013.01)

(58) Field of Classification Search
CPC ..... E04H 6/22; E04H 6/34
USPC ..... 414/234, 235, 238, 241
See application file for complete search history.

(56) References Cited

U.S. PATENT DOCUMENTS 8,734,078 B2 * 5/2014 Benedict ..... E04H 6/225 414/239
2014/0140793 A1 5/2014 Shani

FOREIGN PATENT DOCUMENTS

CN 202148708 U 2/2012
CN 104278872 A 1/2015
CN 204081599 U 1/2015
CN 105525775 A 4/2016
(Continued)

*Primary Examiner* — Saul Rodriguez
*Assistant Examiner* — Willie Berry, Jr.
(74) *Attorney, Agent, or Firm* — Bayramoglu Law Offices LLC

(57) ABSTRACT

An intelligent car garage-moving device based on single-chip microcomputer control, including: a car carrying board, a stereo frame, a shuttle vehicle and a car storage board. The shuttle vehicle includes a running motor, a screw rod, a car lifting board, a supporting rod, a pull rod transmission mechanism, a roller, a guide roller, a car lifting motor and speed reducer, an output shaft gear, a guide roller and a rack. The car lifting motor drives the screw rod to rotate and the pull rod transmission mechanism and the car lifting board to move. The running motor drives the output shaft gear to rotate, and engagement movement of the output shaft gear and the rack drives the shuttle vehicle to move transversely. Though shuttling back and forth of the shuttle vehicle between the car storage board and the car carrying board, the device achieves transverse movement of the car.

2 Claims, 6 Drawing Sheets

(56) References Cited

FOREIGN PATENT DOCUMENTS

| | | | |
|---|---|---|---|
| CN | 206144227 | U | 5/2017 |
| EP | 0331291 | A1 | 9/1989 |

* cited by examiner

INTELLIGENT CAR GARAGE-MOVING DEVICE BASED ON SINGLE-CHIP MICROCOMPUTER CONTROL

CROSS REFERENCE TO RELATED APPLICATIONS

This application is the national phase entry of International Application No. PCT/CN2016/112617, filed on Dec. 28, 2016, which is based upon and claims priority to Chinese Application No. 2016109434325, filed on Oct. 26, 2016, the entire contents of which are incorporated herein by reference.

TECHNICAL FIELD

The present invention relates to the technical field of stereo parking garages and, more particularly, to an intelligent car garage-moving device based on single-chip microcomputer control.

BACKGROUND

With the rapid development of the economy, the number of urban automobiles has been on the rise, while the production and living styles of humans tend to be concentrated, the development of urban public services cannot keep up with the development of the situation, the public parking lot is subjected to tension supply of the public land and the "hard-to-park" problem becomes more and more serious. Along with the proposal of design concepts of establishing stereo garages to utilize the space, a wide variety of stereo garages with different designs are emerging in the market. From the aspect of technical structures, the stereo garages currently available on the market can be mainly divided into several types, such as lift-sliding, laneway-stacker, vertical circulation and cylindrical tower stereo garages.

Technical Problems

Among others, the steel-structured car carrying board of the lift-sliding stereo garage plays roles of bearing loads of parked cars, loads transmitted by mechanisms and speed-induced impact loads. The domestic researches on stereo parking garages mainly focus on the component design of mechanisms and automated control, aiming to improve the garage plot ratio and degree of automation, and reduce the cost. In terms of the existing stereo garages, most of the car carrying boards simply adopt four boards to directly bear wheels, so as to save materials and reduce burden of mechanisms. The transmission mechanism is a parking device that uses a steel wire rope or a chain drive to lift or slide the car carrying board so as to park and take the vehicle, and the structure is simple and easy to construct. However, during the actual design and construction process, the spacing between the chains or the steel wire ropes designed by some manufacturers is not wide enough, and thus the car carrying board for bearing wheels is undersized, and it is rather troublesome for the car owner to park on such a parking device. During a lifting or sliding process, it is very likely to cause an accident, if stability problems occur on the mechanism.

When parking or taking a car in a stereo parking garage, it is necessary to transversely move a parking space correspondingly, for this purpose, a self-contained motor is usually provided on the traversing car carrying board at present, the motor moves on a guide rail along with the car carrying board, and motor cables need to be suspended and slide with the motor when the car carrying board moves. When a multi-row layout is adopted, the up and down movement of the parking space may interfere with the cables. At the same time, when the parking spaces are moved crosswise, interference may also occur, causing cable damage and occurrence of electric leakage accidents, and thus leading to potential safety hazards.

SUMMARY

Technical Solutions

To overcome the above defects, the present invention provides an intelligent car garage-moving device based on single-chip microcomputer control, including: a car carrying board, a shuttle vehicle, a car storage board a stereo frame, in particular, the shuttle vehicle is located on the car storage board, the car storage board is located within the building structure, the car carrying board is located outside of the building structure, transverse movement of the car is achieved through shuttling between the car storage board and the car carrying board of the shuttle vehicle.

The shuttle vehicle is located on the car storage board, and can simultaneously lift the front and rear wheels of the car and thus to lift the car, under transmission of a lifting motor and a lead screw pair. The shuttle vehicle shuttles back and forth between the car storage board and the car carrying board driven by a running motor, and therefore, transverse movement of the car is achieved, and two processes of moving a car in and out of the stereo parking garage are completed.

The shuttle vehicle starts after being responsive to a logic signal sent by a single chip microcomputer control system. The car lifting motor and speed reducer starts first, after torque transformation, the outputted power drives lifting and lowering of a car lifting board. Upon completion of lifting and lowering, the running motor starts, and drives the shuttle vehicle to move transversely also after torque transformation. The single chip microcomputer control system sends an instruction to brake the shuttle vehicle. After the shuttle vehicle stops, the car lifting motor and speed reducer drives lifting and lowering of a car lifting board again, and upon completion of lifting and lowering, the running motor drives the shuttle vehicle back to its initial position.

Moving a car in a garage refers to a process of moving the car from the car carrying board to the car storage board within the building, driven by a shuttle vehicle; moving a car out of a garage refers to a process of moving the car from the car storage board within the building to the car carrying board, driven by a shuttle vehicle.

Beneficial Effects

The advantages of the device according to the present invention mainly lie in that: 1, the vehicle is placed with higher stability and safety; 2, power transmission is stable and reliable, taking and placing of vehicles is rapid and convenient; 3, compared to simple chain drive, the device has lower noise.

BRIEF DESCRIPTION OF THE DRAWINGS

FIG. 2(*b*) is a schematic structural diagram of a top view of the shuttle vehicle.

FIG. 4(*b*) is a schematic diagram of a front view of the photoelectric switch reading the encoding stopper.

DESCRIPTION OF THE REFERENCE NUMERALS

1. car carrying board; 2. stereo frame; 3. shuttle vehicle; 4. car storage board; 5. running motor; 6. screw rod; 7. car lifting board; 8. supporting rod; 9. pull rod transmission mechanism; 10. roller; 11. guide roller; 12. car lifting motor and speed reducer; 13. output shaft gear; 14. guide roller; 15. rack; 16. stopper; 17. stopper fixing plate; 18. photoelectric switch.

DETAILED DESCRIPTION OF THE INVENTION

The present invention will be described in detail with reference to the accompanying drawings and specific embodiments.

Figure 1:
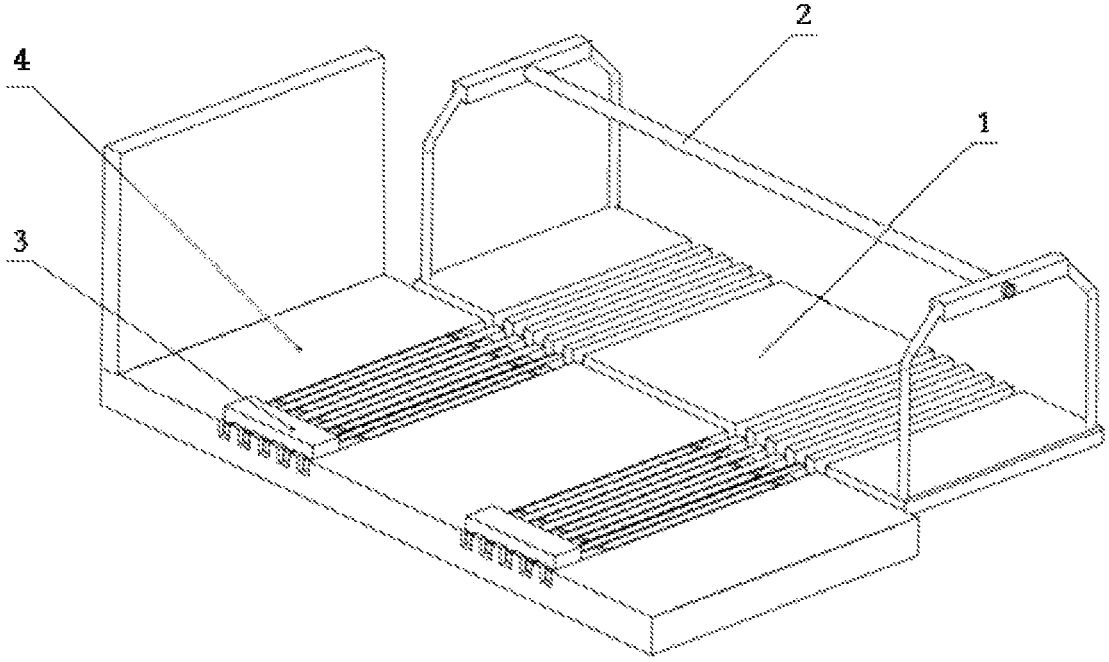
FIG. 1 is a schematic structural diagram of a car garage-moving device.

Referring to FIG. 1, a car garage-moving device comprises a car carrying board 1, a stereo frame 2, a shuttle vehicle 3 and a car storage board 4, the car carrying board 1 has a structure of a comb-shaped chute, to facilitate the entry of a car moving frame to move the car, and meanwhile, the surface of the car carrying board 1 is designed for anti-slip purpose, reducing the possibility of vehicle slipping; a structure of the stereo frame 2 is provided at the periphery of the car carrying board, with roles of keeping balance of the car carrying board, reducing shaking amplitude of the car carrying board in operation, and avoiding vibration due to the shaking of the car carrying board and mechanical noise during operation of the system. Parking and picking up cars are achieved through movement of the shuttle vehicle between the car storage board 4 and the car carrying board 1. The stereo frame 2 is in cooperation with the stereo garage lifting system to drive the car carrying board 1 to perform ascending and descending movement along with the stereo garage.

Figure 2A:
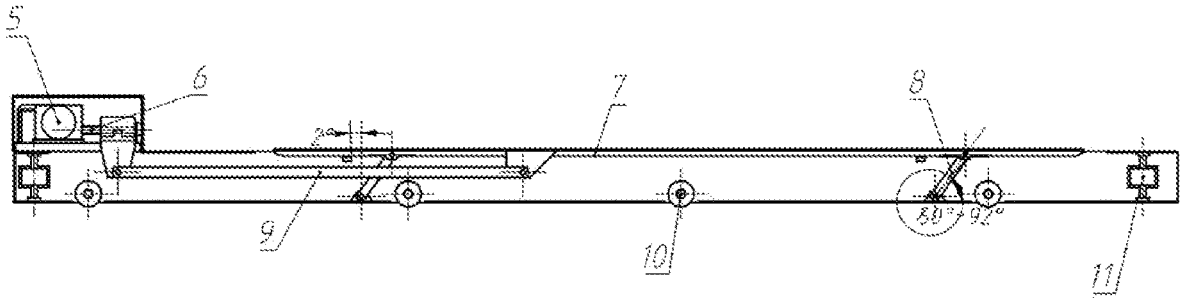
FIG. 2(*a*) is a schematic structural diagram of a front view of a shuttle vehicle.
Figure 2B:
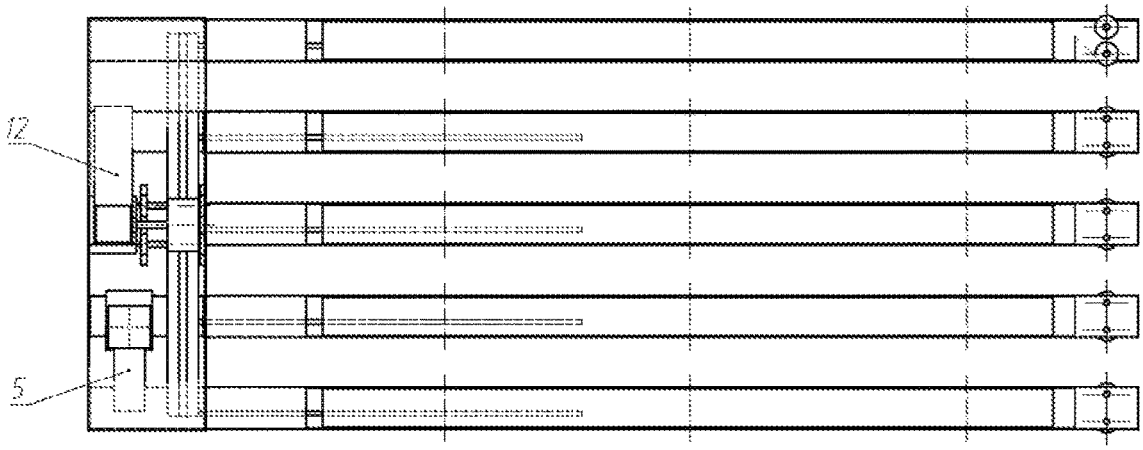
Figure 3:
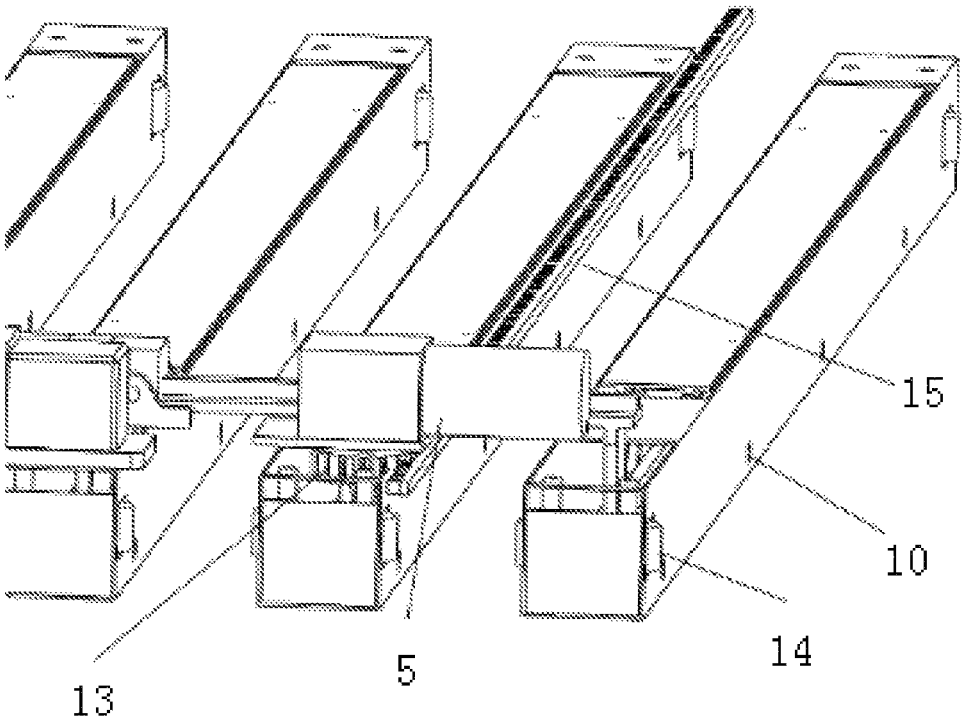
FIG. 3 is a schematic diagram showing the movement of a shuttle vehicle.

Referring to FIG. 2 and FIG. 3, the shuttle vehicle 3 mainly comprises a running motor 5, a screw rod 6, a car lifting board 7, a supporting rod 8, a pull rod transmission mechanism 9, a roller 10, a guide roller 11, a car lifting motor and speed reducer 12, an output shaft gear 13, a guide roller 14 and a rack 15. The car lifting motor and speed reducer 12 is provided within the shuttle vehicle, an output shaft of the car lifting motor and speed reducer 12 is connected to the screw rod 6 via a coupling, the screw rod 6 is connected to the pull rod transmission mechanism 9 by a screw thread pair transmission structure, the pull rod transmission mechanism 9 is articulated with the car lifting board 7, one end of the supporting rod 8 is articulated with the car lifting board 7, the other end of the supporting rod 8 is fixedly connected to the bottom of the shuttle vehicle 3. The rack 15 is mounted on a side surface of the car storage board 4, and the rack 15 is stationary relative to the ground. The guide roller 11 and the roller 10 are mounted on the bottom of the shuttle vehicle 3, to ensure the moving direction and stability of the shuttle vehicle and reduce the friction between the shuttle vehicle and the car carrying board 1, and thus reduce abrasion of the mechanism and the occurrence of noise. The roles of the entire mechanism are to complete a moving process of the vehicle between the car storage board 4 and the car carrying board 1 as well as a lifting and lowering process of the car lifting board 7.

The lifting and lowering process of the car lifting board is as follows: when the car lifting motor and speed reducer 12 operates, the screw rod 6 rotates to drive the pull rod transmission mechanism 9 and the car lifting board 7 to move, causing the supporting rod 8 below the car lifting board 7 to rotate about a pivot point and achieving the motion of the car lifting board 7 to lift the car. The transverse movement of the shuttle vehicle 3 is as follows: the running motor 5 drives the output shaft gear 13 to rotate, and engagement movement of the output shaft gear 13 and the rack 15 drives the shuttle vehicle 3 to move transversely.

Figure 4A:
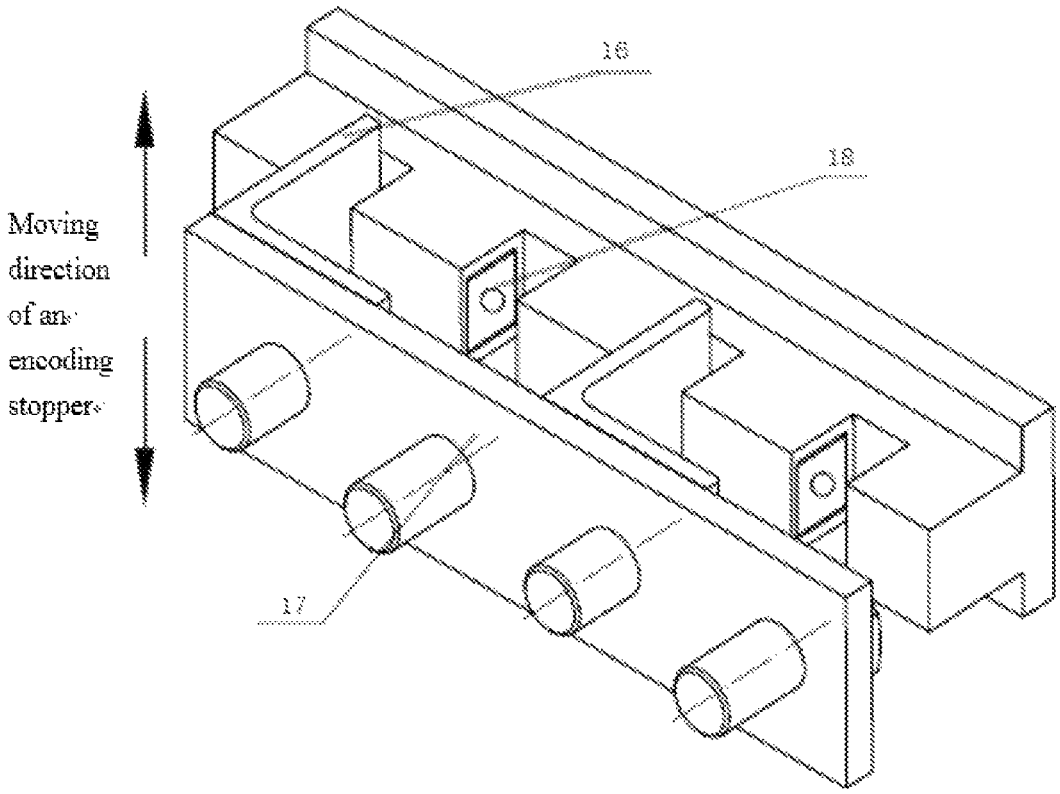
FIG. 4(*a*) is a schematic diagram of a schematic perspective view of a photoelectric switch reading an encoding stopper.
Figure 4B:
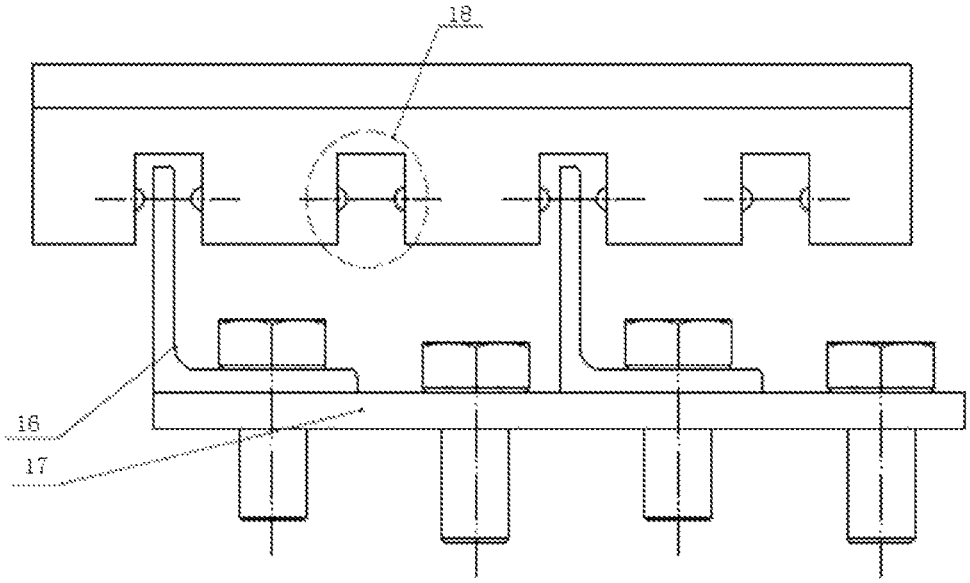

Referring to FIG. 4, since there are too many motors to be controlled in the entire stereo garage, a main control system and a car carrying and traversing execution system are separated, that is, the main control system controls parking and taking of a vehicle and other related portions, and the execution system of a car storage frame in each story controls moving in and out of a car. When the shuttle vehicle is transferring a car, a circulating car frame is not allowed to move. Therefore, when the car carrying and traversing execution system operates, the stopper 16 is not sensed by the photoelectric switch 18, and the photoelectric switch 18 feeds its operating state back to the main control system, and then the circulating car storage frame doesn't need to rotate and needs to be seized up.

Figure 5:
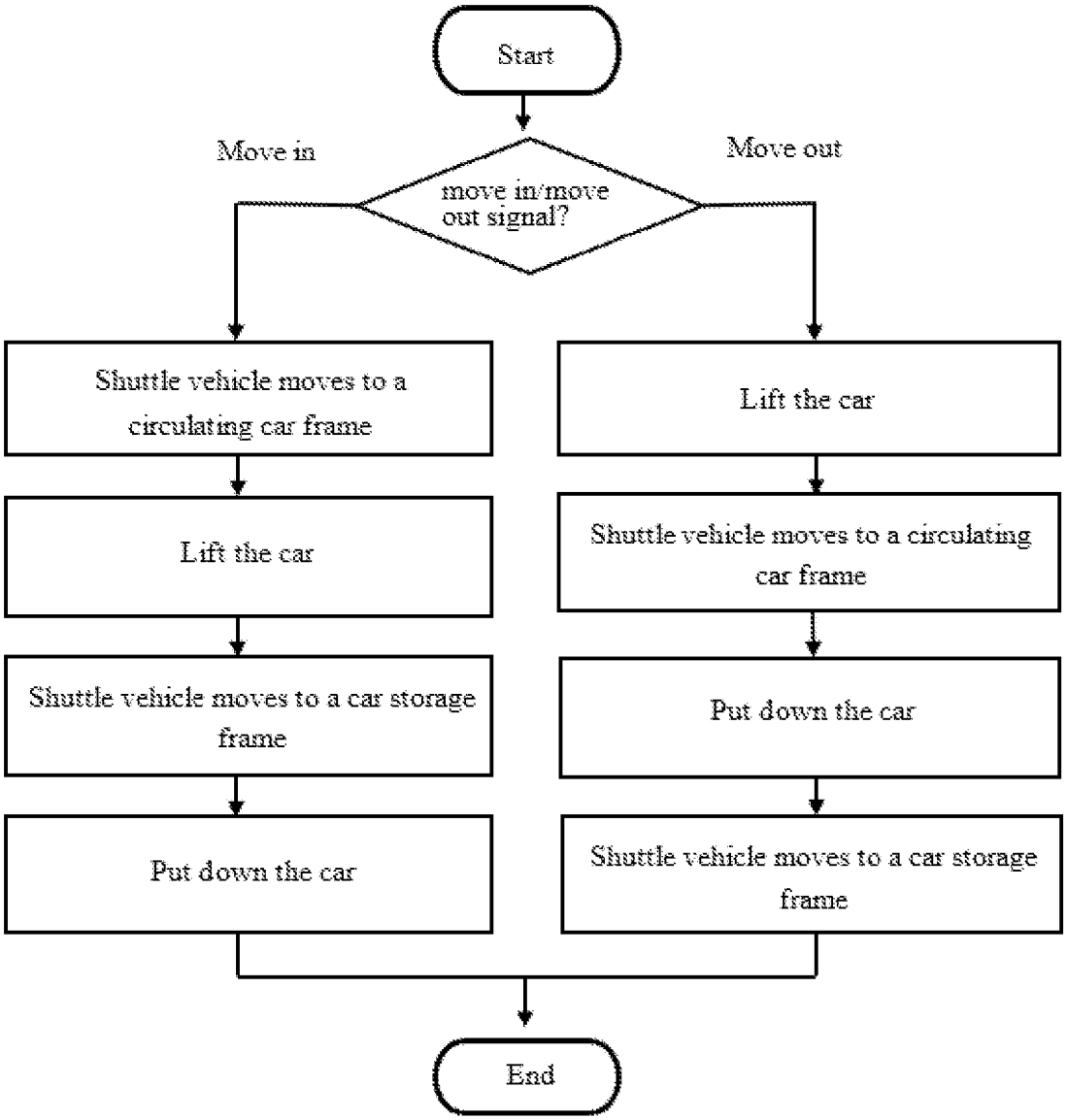
FIG. 5 is a control flowchart of a shuttle vehicle.

FIG. 5 is a control flowchart of moving a car in/out via a shuttle vehicle.

Figure 6:
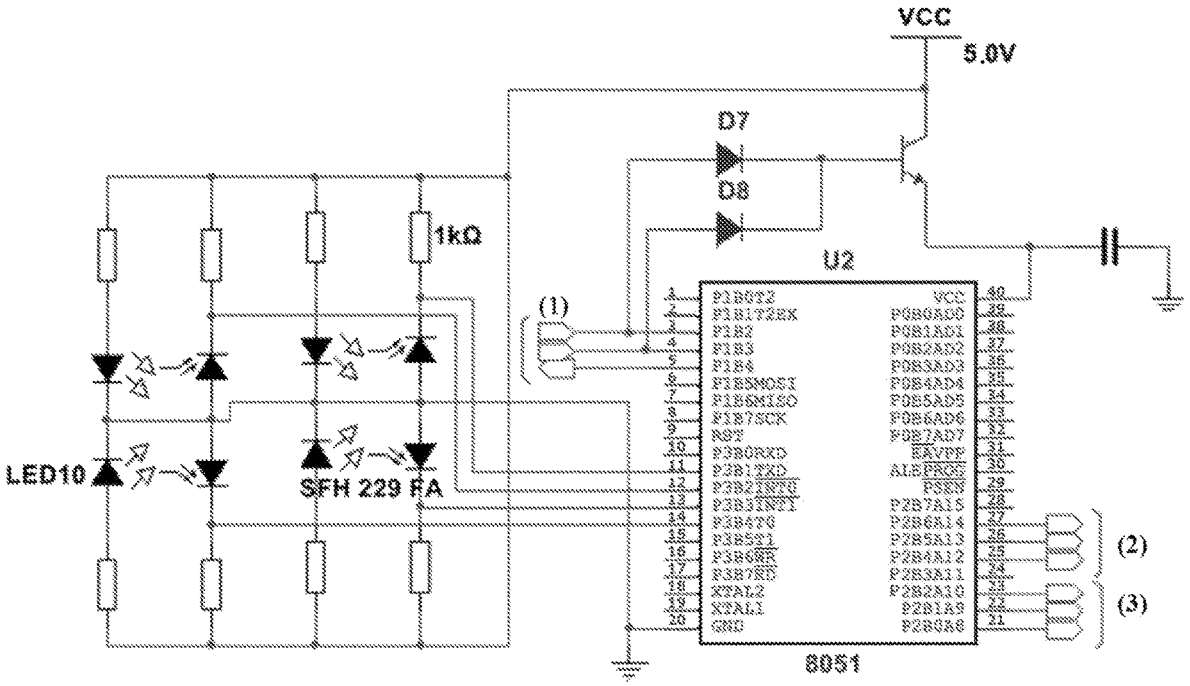
FIG. 6 is a control circuit diagram of a shuttle vehicle.

FIG. 6 shows an execution system control circuit, particularly, (1) is to connect moving in/out signal lines and operating state indicating line of the main control circuit; (2) is to connect a running motor controller of the shuttle vehicle; (3) is to connect a car lifting motor controller, and two of the photoelectric switches are used to determine a start point/an end point of a travelling position of the shuttle vehicle; another two of the photoelectric switches are used to determine a start point/an end point for lifting of the car lifting board, and the portion consisting of two diodes (D7, D8) and a triode is used to turn on/off the single-chip microcomputer, when the main control circuit sends an instruction of parking/taking a car, the single-chip microcomputer is turned on, while there are no signals, single-chip microcomputer is turned off.

It should be noted that persons skilled in the art can make various improvements and modifications without departing from the principle of the present invention, and these improvements and modifications should also be considered as the protection scope of the present invention. The components that are not clearly defined in this embodiment can be implemented by the prior art.

What is claimed is:

1. An intelligent car garage-moving device based on a single-chip microcomputer control, comprising: a car carrying board, a stereo frame, a shuttle vehicle and a car storage board; wherein, the shuttle vehicle is located on the car storage board, the car storage board is located within a building structure, the car carrying board is located outside the building structure, a transverse movement of the car is achieved through shuttling between the car storage board and the car carrying board of the shuttle vehicle;

wherein, the shuttle vehicle comprises a running motor, a screw rod, a car lifting board, a supporting rod, a pull rod transmission mechanism, a roller, a first guide roller, a car lifting motor and speed reducer, an output shaft gear, a second guide roller and a rack; the car lifting motor and speed reducer is provided within the shuttle vehicle, an output shaft of the car lifting motor and speed reducer is connected to the screw rod via a coupling, the screw rod is connected to the pull rod transmission mechanism by a screw thread pair transmission structure, the pull rod transmission mechanism is articulated with the car lifting board, one end of the supporting rod is articulated with the car lifting board, the other end of the supporting rod is fixedly connected to a bottom of the shuttle vehicle, the rack is mounted on a side surface of the car storage board, the first guide roller, the second guide roller and the roller are mounted on the bottom of the shuttle vehicle;

wherein, the car lifting motor drives the screw rod to rotate and the pull rod transmission mechanism and the car lifting board to move, causing the supporting rod below the car lifting board to rotate around a pivot point and achieving a motion of the car lifting board to lift the car, secondly, the running motor drives the output shaft gear to rotate, and engagement movement of the output shaft gear and the rack drives the shuttle vehicle to move transversely.

2. An intelligent car garage-moving device based on a single-chip microcomputer control, comprising: a car carrying board, a stereo frame, a shuttle vehicle and a car storage board; wherein, the shuttle vehicle is located on the car storage board, the car storage board is located within a building structure, the car carrying board is located outside the building structure, a transverse movement of the car is achieved through shuttling between the car storage board and the car carrying board of the shuttle vehicle;

wherein, the shuttle vehicle comprises a running motor, a screw rod, a car lifting board, a supporting rod, a pull rod transmission mechanism, a roller, a first guide roller, a car lifting motor and speed reducer, an output shaft gear, a second guide roller and a rack; the car lifting motor and speed reducer is provided within the shuttle vehicle, an output shaft of the car lifting motor and speed reducer is connected to the screw rod via a coupling, the screw rod is connected to the pull rod transmission mechanism by a screw thread pair transmission structure, the pull rod transmission mechanism is articulated with the car lifting board, one end of the supporting rod is articulated with the car lifting board, the other end of the supporting rod is fixedly connected to a bottom of the shuttle vehicle, the rack is mounted on a side surface of the car storage board, the first guide roller, the second guide roller and the roller are mounted on the bottom of the shuttle vehicle;

wherein, the shuttle vehicle sequentially performs a starting of the car lifting motor and speed reducer and the running motor, responsive to a logic signal sent by a single chip microcomputer control system, and the single chip microcomputer control system sends an instruction to brake the running motor when the shuttle vehicle is braked.

* * * * *